US005800196A

United States Patent [19]

Rudoy et al.

[11] Patent Number: 5,800,196

[45] Date of Patent: Sep. 1, 1998

[54] HERMAPHRODITIC ELECTRICAL CONNECTOR

[75] Inventors: Edward Rudoy, Woodland Hills; Leslie Laszlo Kerek, Los Angeles, both of Calif.; Gary D. Burns, Inver Grove Heights, Minn.

[73] Assignee: Tri-Star Electronics International, Inc., El Segundo, Calif.

[21] Appl. No.: 701,168

[22] Filed: Aug. 21, 1996

[51] Int. Cl.[6] ..... H01R 13/28

[52] U.S. Cl. ..... 439/284; 439/460

[58] Field of Search ..... 439/284, 292, 439/460, 463, 464, 290, 291

[56] References Cited

U.S. PATENT DOCUMENTS 2,384,267 9/1945 Anderson ..... 439/284

4,900,261 2/1990 Gentry et al. .

4,963,102 10/1990 Gettig et al. .

5,259,780 11/1993 Morrissey, III et al. .

5,277,627 1/1994 Matsuzaki .

*Primary Examiner*—Khiem Nguyen

*Assistant Examiner*—Eugene G. Byrd

*Attorney, Agent, or Firm*—Harold L. Jackson

[57] ABSTRACT

An electrical connector that includes a pair of hermaphroditic electrical connector members which are identically formed having a connector body supported within a flexible jacket, wherein the connector body includes a male plug and a female receptacle, whereby the first male plug of the first connector is positioned to be coupled to the second female receptacle of the second connector, and wherein the first female receptacle of the first connector is arranged to be coupled to the second male plug of the second connector when one of the connector members is inverted and latched to the opposing connector member.

35 Claims, 3 Drawing Sheets

HERMAPHRODITIC ELECTRICAL CONNECTOR

BACKGROUND OF THE INVENTION

1. Field of the Invention

The present invention relates to an electrical connector for use, for example, to make an electrical connection between railroad cars for controlling the braking systems, and more particularly to a pair of hermaphroditic electrical connector members for such use or other uses.

2. Description of the Prior Art

The braking systems on railroad freight cars are pneumatically operated with air under pressure provided from the locomotive or other central location. The brakes are arranged to set automatically in the absence of air pressure and to be released in the presence of air pressure. Once the cars are coupled to the locomotive the brakes on all of the cars are either in a set or released mode, except for transient conditions, ie., when the brakes are initially applied or released at the locomotive, due to time required for the air under pressure to travel down the line of cars.

It has been long recognized in the railroad industry that there is a need to be able to control the brakes of individual freight cars. This would allow the braking system on each freight car to be remotely operated by the train engineer from the locomotive cab. Until the present there has been no improvement over the braking systems or the coupling devices that would allow the cars to be remotely activated. There are several ways this can be done with a suitable computer system that allows signals to be sent to selected freight cars or to an individual car from a central location, ie., the locomotive, which would permit the brakes of one or more of the freight cars to be applied independently of the operation of the brakes in other cars. For example, when a long freight train is passing over a hill it would be desirable to be able to brake the cars on the down grade side without braking the cars which are still moving up the grade. In addition, any electrical path from the locomotive to the cars coupled thereto would enable electrical signals to be sent to and received from the individual cars so that information concerning any malfunction of the braking system in each car could be relayed to the locomotive to provide a warning signal etc.

However, before such a system or program can be put into operation, there needs to be provided an electrical connector that can be readily adapted to be positioned in series between each freight car at a point relative to the train's coupling devices so that electric signals can be sent to any freight car for remotely activating (or integrating) various components that might be mounted to the cars. Since either end of a freight car can be positioned towards the locomotive either two male/female connector halves or a single genderless, ie., hermaphroditic, connector half must be used at each end of each car to provide the necessary electrical connections.

Such a connector or connectors must be capable of being disconnected manually or automatically when the cars are separated. For example, at the present time, when one or more freight cars are to be sidetracked or separated from the train's locomotive, the train engineer will manually release the coupling apparatus when the cars are in position for separation. The air supply system is also disconnected on the selected car either manually or automatically when the car or cars are separated from the adjoining cars whereby air pressure in the braking system for the uncoupled car or cars is released, thereby automatically causing the brakes in separated freight cars to be set. Any electrical connection between the cars must accommodate the coupling and uncoupling operation.

In addition, the electrical connector or connections must be capable of tolerating adverse weather conditions such as rain, freezing temperatures, etc. Accordingly, an electric connector is needed that is simple and rugged in construction, which can be readily sealed to prevent damage from an unfavorable environment and which can be manually connected or disconnected and automatically disconnected when cars are separated. Preferably such a connector would be of the hermaphroditic type thereby eliminating the need for an extra connector at the end of each car.

As an example of a hermaphroditic connector (used for entirely different purpose) one may refer to U.S. Pat. No. 4,963,102, issued to William A. Gettig et al. This connector is typically provided with a pair of electrical members, each of which is provided with a pair of electrical members, each of which is adapted to receive snap-fitting conductor terminals which are joined in a mating relationship upon inverting one of the connector members. This connector employs a body having electrical conductor terminals each of which is in the form of a blade with lateral tongs, lock lugs and overlying spring arms.

SUMMARY AND OBJECTS OF THE INVENTION

Accordingly, the present invention as disclosed herein is constructed and defined as a hermaphroditic electrical connector having a pair of connector members that are identically arranged and constructed with each having a connector body that is suitably enclosed in a shell or flexible jacket, a portion of which is formed to aid in the operation of a quick-disconnect latching device. Mounted within each connector body is a male plug or connector pin which is attached to one of the wires of a electrical cable and a female receptacle attached to the other wire of the electrical cable. Both the plug and receptacle are disposed in respective bores formed within each connector body and are arranged to be coupled to their respective counterparts as the pair of connector members are coupled together. Therefore, as the two connector members are joined the male plug of one member is coupled to the female receptacle of the other member, whereby each releasable latching device is oppositely disposed so as to be inversely locked to each respective connector member along two opposite sides.

Accordingly, it is an important object of the present invention to provide an improved hermaphroditic connector that defines a simple but novel arrangement of a pair of electrical connector members that when coupled together establish an enclosed sealed environment between the outer jackets of the respective connector members, and whereby each spring latching member is respectively sealed therein.

Another object of the invention is to provide a hermaphroditic electrical connector comprising a pair of hermaphroditic electrical connector members, defined by a first connector member formed having a first body member which includes a first male plug member and a first female receptacle, and a second connector member having a second body member which also includes a corresponding second male plug member and a second female receptacle. The first and second connector members are identically formed within their respective body members, wherein the first male plug is positioned to be coupled in the second female receptacle, and wherein the first female receptacle is positioned to be coupled to the second male plug, whereby the coupled connector members are removably latched together by means of the oppositely disposed latching means.

The characteristics and advantages of the invention are further sufficiently referred to in connection with the accompanying drawings, which represents one embodiment. After considering this example, skilled persons will understand that variations may be made without departing from the principles disclosed; and we contemplate the employment of any structures, arrangements or modes of operation that are properly within the scope of the appended claims.

DESCRIPTION OF THE PREFERRED EMBODIMENT

Figures 1, 2, 3:
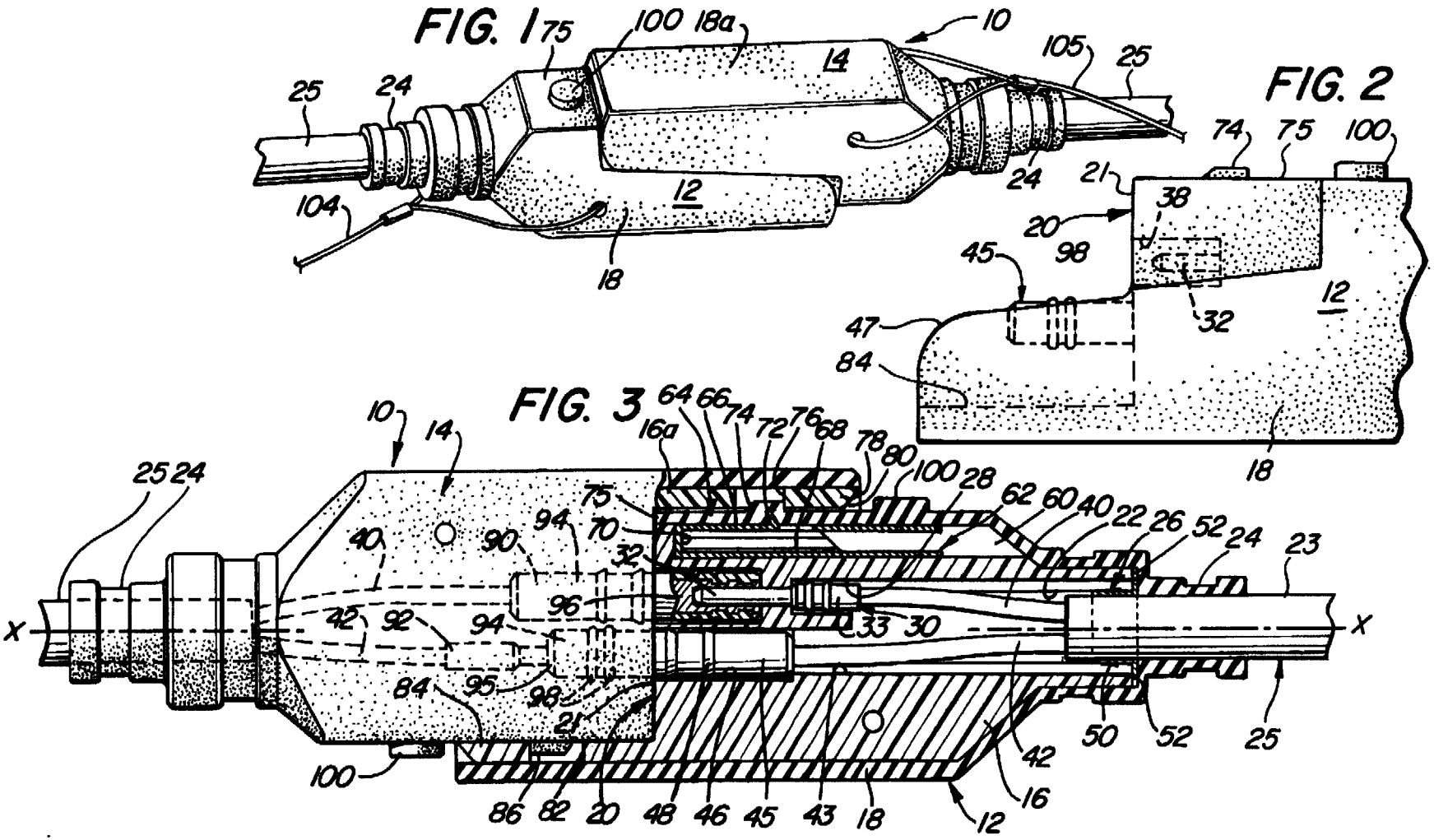
FIG. 1 is a pictorial view of the present invention defining a hermaphroditic electrical connector comprising a pair of hermaphroditic electrical connector members inversely coupled together to which a pair of tether lines are connected.
FIG. 2 a partial side elevational view of one of the electrical connector members.
FIG. 3 is an enlarged side elevational view of the reverse side as shown in FIG. 1, wherein a portion of the connector member is broken away to illustrate the interior arrangement of the components therein.

Referring now to the drawings and more particularly to FIGS. 1 and 3, there is shown a hermaphroditic electrical connector, generally indicated at 10, which is defined by a pair of hermaphroditic electrical connector members that comprise a first connector member 12 and a second connector member 14, wherein both connector members 12 and 14 are identically formed having corresponding components as will be hereinafter described. In these two views the two connector members are shown interconnected so as to define hermaphroditic electrical connector 10 which can be adapted to form various applications and industrial uses but is particularly designed for use in providing a suitable electrical connection between railroad cars, especially freight cars. Due to the unique structure and components of the present invention the first and second connector members 12 and 14 will hereinafter be described individually so that a clearer understanding of their relationship to each other can be readily understood since both connector members are joined in a mating relationship, wherein one connector member is inverted with respect to the other when they are coupled together, as illustrated in FIGS. 1 and 3.

The first connector member 12, shown on the right hand side of FIG. 3, comprises a first connector body 16 that is substantially covered by a flexible impermeable jacket or shell 18 (made, for example, of rubber or plastic). The connector member is arranged along a longitudinal axis x—x and has a coupling end, indicated generally at 20, which is readily clear and open to receive the second connector member 14, as shown in FIGS. 2 and 3. The first connector body 16 is formed with a substantially vertical wall 21 (perpendicularly disposed to the longitudinal axis) and includes an enlarged passage 22 that is formed at the opposite end from that of coupling end 20. The open end of passage 22 is covered by an extended nipple member 24 which is formed as an integral part of jacket 18. Nipple member 24 is aligned with passage 22, whereby an outer sheath 23 of an electrical cable 25 is fixedly mounted in passage 22 by a cable securing means, generally indicated at 26, and sealed therein by nipple member 24. A small bore 28, formed in body 16, communicates with passage 22 and is adapted to receive a first male electrical plug 30. Plug 30 is defined by a connector pin 32 at one end which is recessed from the wall 21 and an enlarged boss 33 at the opposite end which includes a plurality of annular wedge-shaped members for engaging the annular inner wall of bore 28. Pin 32 is positioned to extend through the end wall of bore 28 so as to be freely positioned within a contiguous enlarged cylindrical bore 38, as illustrated in FIGS. 2 and 3. Boss 33 is also adapted to receive a wire 40 that extends from electrical cable 25.

A second wire 42 extends from the electrical cable 25 through a reduced passage 43 and is connected to a female receptacle 45 which is fixedly mounted in an elongated bore 46 by holding means defined as a plurality of wedged-shaped annular rings 48. Female receptacle 45 extends outwardly from wall 21, also illustrated in FIGS. 2 and 3. The connector body 16 includes vertically oriented side wall sections 47 which extend upwardly from a lower wall portion or shelf 84 on either side of the forwardly protruding female receptacle 45 and to a height substantially commensurate with the upper surface of the receptacle, as is illustrated in FIG. 2.

Figures 5, 6:
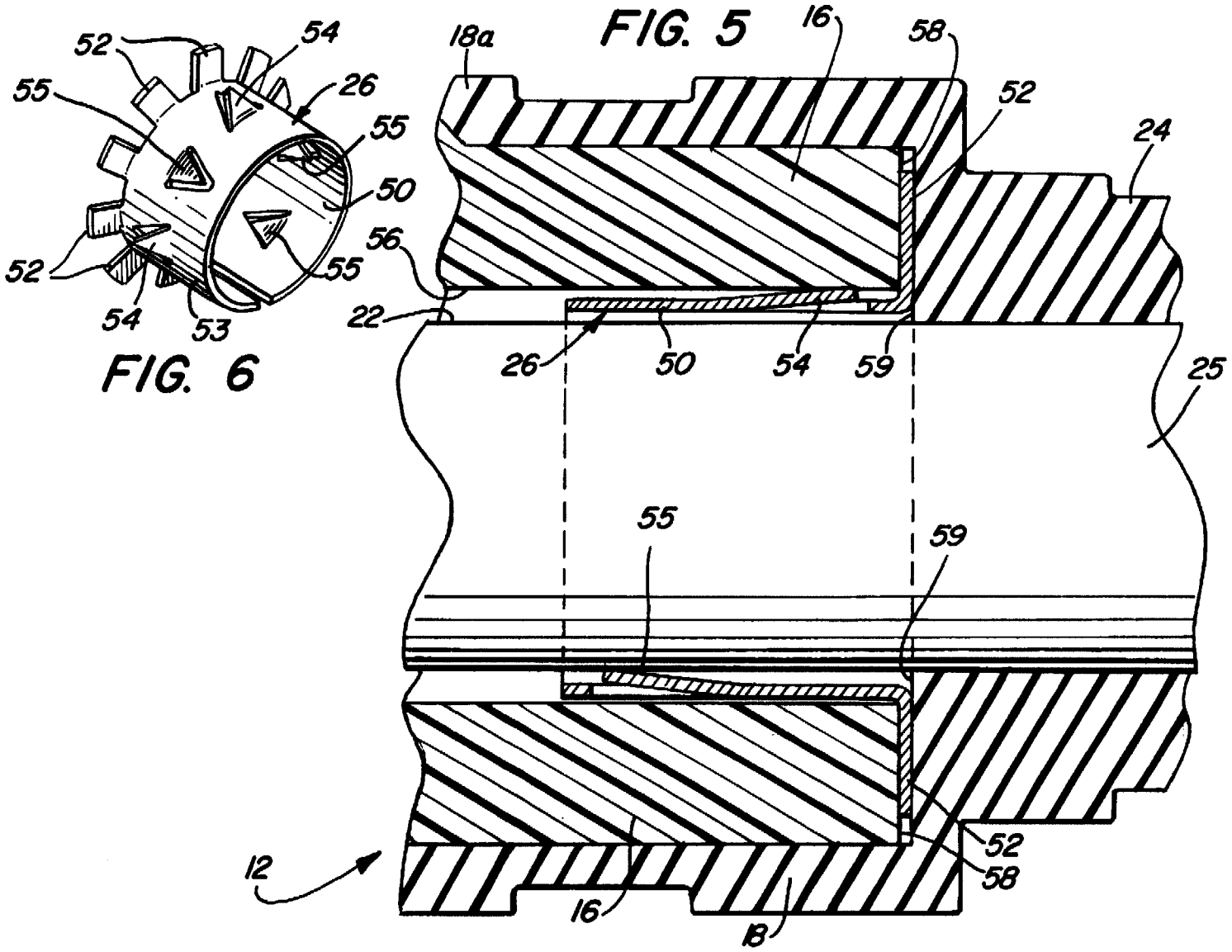
FIG. 5 is an enlarged sectional view of the cable connecting end of one of the electrical connector members, wherein the cable is shown secured within the distal end of the main body of the connector member.
FIG. 6 is a perspective view of the securing ring that holds the cable fixed within the connector member.

The cable securing means 26 is defined as split ring 50 formed preferably with a plurality of annular flange members 52. The split ring 50 includes a tubular section 53 having a plurality of angularly extending triangular-shaped spike members 54 and 55 as is more clearly illustrated in FIG. 6. Spike members 54 extend radially outwardly and are arranged to lockingly engage annular wall 56 of passage 22. Spike members 55 extend radially inwardly and are arranged to engage the outer sheath 23 of cable 25, as more clearly shown in FIG. 5. Annular flange members 52 are interposed between the open end 58 of passage 22 and the inner shoulder 59 of the jacket nipple member 24, as is illustrated in FIGS. 3, 5 and 6. Nipple member 24 fits snugly on the sheath or outer surface of cable 25, thus further defining a sealing means to prevent foreign matter, such as water, from entering into passage 22, thereby protecting the wires from corrosion, for example.

In FIG. 3, there is shown an elongated channel 60 that is formed in the upper portion of first connector body 16 and is adapted to receive a spring or biasing means that comprises a latching means 62 which includes a one-piece spring clip or latch 64 defined by a pair of outwardly extended arm members 66 and 68 that are integrally connected by a centrally disposed base member 70. See FIG. 4. The upper spring arm member 66 is provided with a keeper member 72 that extends outwardly from arm 66. The keeper member is bent forwardly at an angle to the longitudinal axis x—x so as to be fixedly secured within an outwardly protruding boss member 74 that is formed in flexible wall 75 of jacket 18. Boss member 74 is adapted to be received in a recess 76 that is formed in an extended wall portion 9 (or shelf) 78 of second body member **16*a*. The recess 76** is sometimes referred to as the latch engaging portion.

The latching means 62 further includes the recess 76 and the protruding boss member 74. It should be noted, however, that the spring clip 64 may be arranged to seat in the recess 76 in the event that the jacket 18 is designed to stop short of the recess 76. Both the projecting boss 74 and the leading edge 80 of wall portion 78 are formed having beveled edges that engage each other to depress the latching spring as the two connector members 12 and 14 are inversely connected.

It should be noted that first body member 16 is also formed having a recess 82 disposed in wall portion or shelf 84 which is identical to recess 76 and wall portion 78 of the second body member **16*a*, wherein a boss member 86 is also removably received in recess 82 by a second latching means to which boss member 86 is a part thereof. Again, both respective first and second connector members 12 and 14 are identically constructed and have the same components identically arranged so that when inversely connected together they define the hermaphroditic electrical connector 10** of the present invention.

When the two connector members 12 and 14 are coupled together so as to be interconnected with each other, as illustrated in FIG. 3, connector pin 32 of male electrical plug 30, which is mounted in connector member 12, is inserted into female receptacle indicated generally at 90, which is fixedly mounted in second connector body **16*a* of connector member 14. At this same time a second male plug 92 in the second connector body 16*a* is plugged into female receptacle 45 which is secured in connector member 12. Each female receptacle 45 and 90 is formed having an outer insulated housing 94 in which is mounted an electrical conductive socket 96 adapted to be removably coupled to the respective compatible male plug 30. Housings 94 are in the form of tubular posts or sleeves. The portions of the housing which extend forwardly of the wall 21 are provided with one or more sealing rings 98 that are adapted to be received in the bores 38 that surround and enclose each respective connector pin 32. The free end of each receptacle post 94 includes a beveled surface 95 as illustrated in FIG. 3. It is to be noted the male plugs 32 and 92 as well as the female receptacles 45 and 90** are identical.

Figure 4:
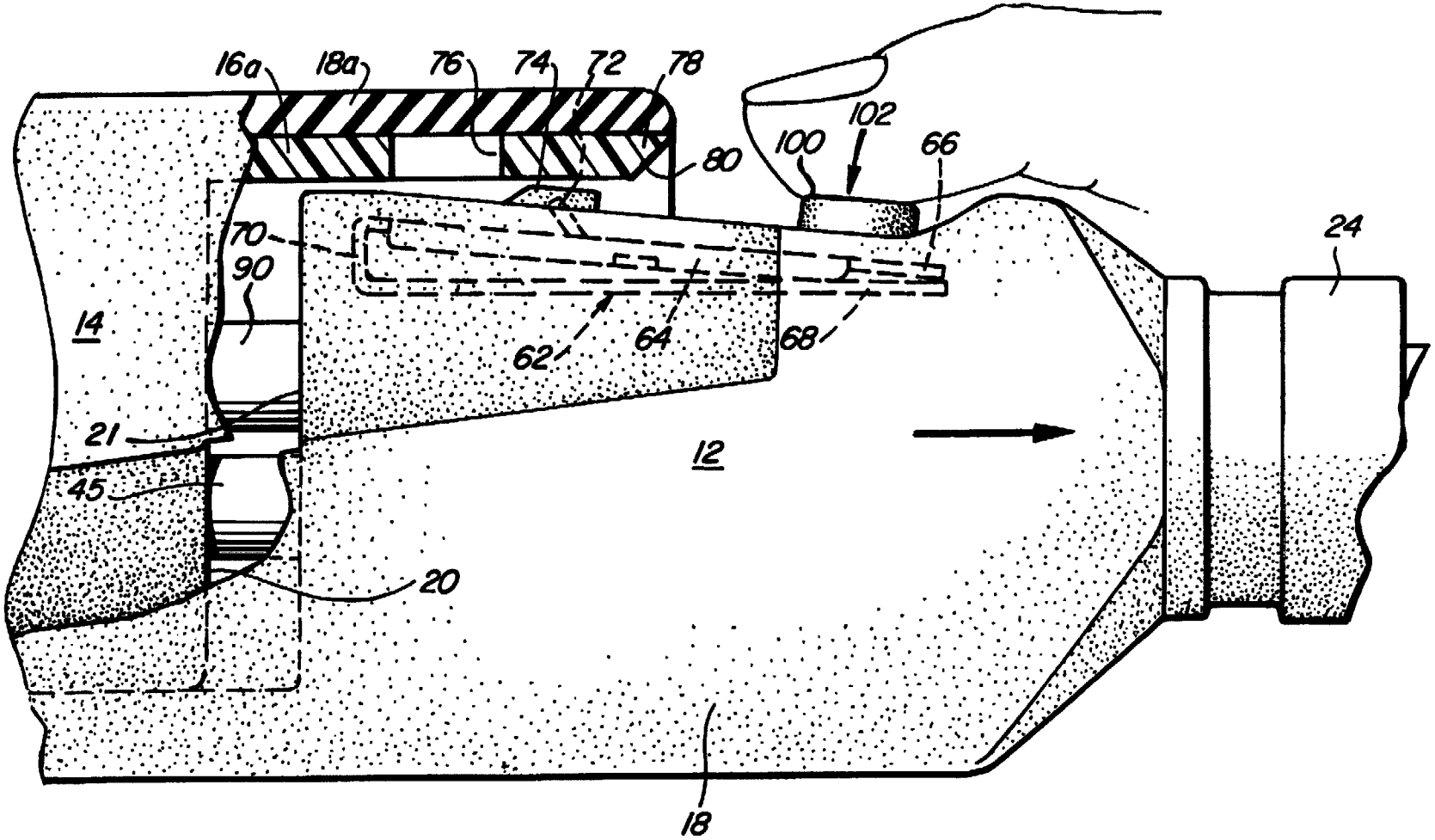
FIG. 4 is an enlarged side view of a portion of one of the electrical connector members illustrating the latching device of the invention.

In order to manually separate connector members 12 and 14 from each other each spring arm 66 (sometimes referred to as the latch release arm member) of each latching means 62 must be depressed, as illustrated in FIG. 4. As the protruding manual release button 100 is pushed downwardly, as indicated by arrow 102, the spring arm 66 is bent downwardly, whereby boss 74 is freed from engagement with recess 76, at which time the two connector members 12 and 14 can be readily pulled apart.

Separating means is further provided by the use of a pair of tether lines or lanyards 104 and 106, as illustrated in FIG. 1. The tether lines have a shorter overall length than their corresponding electrical cables 25. Accordingly, as the freight cars are separated the pulling force on the tether lines 104 and 106 (being shorter than the corresponding cables 25) will forcibly pull the two connector members apart and overcome latching means 62, causing the boss 74 to be disengaged due to the angular position of keeper member 72. That is, the pliable material of boss 74 which is formed around keeper member 72 will yield, thus allowing the two connector members to separate similar to that when spring arm 66 is manually operated, as seen in FIG. 4. This provides a quick and easy separation of the two joined connector members without putting an excessive amount of force or strain on the electrical cables 25 at any time during their latched mode. The force required to separate the two connectors by the tether lines can be adjusted, e.g., 100 to 200 pounds, by changing the angle of the keeper member 72. The closer the orientation of the keeper members approach a right angle to the longitudinal axis x—x (FIG. 3), the greater the force required to separate the connector members by the tether lines.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What is claimed is:

1. A hermaphroditic electrical connector defined by a pair of connector members wherein each of said connector members comprises:

a connector body which is defined by a coupling end and an oppositely disposed electrical cable receiving end defined by a passage in which a electrical cable is fixedly secured;

a resilient jacket formed to substantially cover said connector body, whereby said coupling end is exposed;

a latching means positioned in said connector body and covered by said jacket, wherein said latching means is enclosed between said jacket and said connector body the latching means including a manual release member which, when actuated, allows the connector members to be separated with the jackets covering each connector body; and a male plug and a female receptacle mounted in said connector body in juxtaposition to each other.

2. A hermaphroditic electrical connector as recited in claim 1 wherein the latching means includes a recess formed in and a spring biased latch carried by said connector body, wherein said spring biased latch of one connector body is arranged to engage said recess formed in the other connector body when one of said connector members is connected inversely to the other connector member.

3. A hermaphroditic electrical connector as recited in claim 2, wherein said electrical cable mounted in said connector body includes a pair of wires, whereby one of said wires is secured to said male plug and said other wire is secured to said female receptacle.

4. A hermaphroditic electrical connector as recited in claim 3, wherein said spring biased latch is defined by a pair of extended biasing arm members, wherein one of said biasing arm members is formed with an angularly disposed keeper member fixedly attached to a boss member formed in said jacket for locking engagement with said recesses of said inverted connector body.

5. A hermaphroditic electrical connector as recited in claim 4, wherein said female receptacle is formed having an outer insulated housing in which is disposed an electrical conductive socket to which one of said cable wires is connected.

6. A hermaphroditic electrical connector as recited in claim 5, wherein said connector member includes a tether line.

7. A hermaphroditic connector as recited in claim 1 wherein each connector body has a front wall located at the coupling end and disposed generally in a plane perpendicular to the longitudinal axis with a cylindrical cavity extending rearwardly thereof for receiving the female receptacle, the male plug being disposed within the cavity, each female receptacle comprising an insulating post having an axial bore therein and an electrically conducting socket secured within the bore, the post extending forwardly of the front wall to form a free forward end, the connector body further defining a pair of spaced side wall sections extending on each side of the female receptacle post which projects forwardly of the front wall.

8. A hermaphroditic electrical connector defined by a pair of connector members wherein each of said connector members comprises:

a connector body which is defined by a coupling end and an oppositely disposed electrical cable receiving end defined by a passage in which a electrical cable is fixedly secured, the connector body defining a latch engaging portion positioned generally toward the coupling end;

a latching spring positioned in said connector body opposite said latch engaging portion, the latching spring being arranged to seat against the latch engaging portion of the mating connector body when the connector members are in a mated position;

a male plug and a female receptacle mounted in said connector body in juxtaposition to each others; and a lanyard secured to the connector body and wherein the latching spring and latch engaging portion are arranged to allow the latching spring to be disengaged from the latch engaging portion of the mating connector body when a predetermined force is applied to the lanyard.

9. A hermaphroditic electrical connector as recited in claim 8 further including a resilient impermeable jacket formed to substantially cover said connector body and the latching spring leaving the coupling end exposed, the jacket including an outwardly projecting boss which engages the latch engaging portion of the other connector body when the connector members are in a mated condition.

10. A hermaphroditic electrical connector as recited in claim 9 wherein the latch engaging portion is a recess and wherein the latching spring includes a keeper member which projects into the boss of the jacket.

11. A hermaphroditic electrical connector as recited in claim 10 wherein the connector body has a longitudinal axis and wherein the keeper member is angularly disposed with respect to the longitudinal axis.

12. A hermaphroditic electrical connector as recited in claim 11 wherein the boss of the jacket has a beveled leading edge for guiding the boss and keeper member into the recess when the connector members are mated.

13. A hermaphroditic electrical connector as recited in claim 12, including a cable securing means.

14. A hermaphroditic electrical connector as recited in claim 13, wherein said cable securing means is defined having a split ring formed with at least one annular flange and a tubular section extending inwardly from the flange, the tubular section having a plurality of outwardly extending spike members arranged to lockingly engage the annular wall of said passage and a second plurality of spike members extending downwardly so as to lockingly engage the outer sheath of said cable.

15. A cable securing device for securing a cable within an inner wall of a tubular passageway comprising a split ring formed with at least one annular flange member and a tubular section, the tubular section having a first plurality of outwardly extending spike members positioned so as to lockingly engage the inner wall of the passageway and a second plurality of spike members extending downwardly so as to lockingly engage the outer sheath of a cable.

16. A cable securing means formed to secure an electrical cable within a cable receiving tubular passageway at the end of an electrical connector, the cable securing means comprising:

a split ring formed with a plurality of annular flange members at one end and a tubular section extending therefrom, the tubular section having a first plurality of outwardly extending triangularly-shaped spike members positioned so as to be lockingly engaged within the receiving end of the tubular passageway and a second plurality of triangularly-shaped spike members extending inwardly so as to be lockingly engaged with the cable.

17. A hermaphroditic electrical connector comprising:

a pair of substantially identical connector members, each connector member including a connector body having a coupling end, a front wall adjacent the coupling end, a cylindrical cavity extending rearwardly from the front wall, an insulating tubular post extending forwardly of the front wall, an electrical cable receiving end disposed opposite the coupling end, and a latch engaging portion adjacent the coupling end;

a male plug mounted within the cylindrical cavity and a female receptacle socket mounted within the forwardly extending tubular post of each connector body, the plug and receptacle socket being arranged to engage the receptacle socket and plug, respectively, of the other connector body when the connector members are in a mated condition;

each connector member further including a spring biased latch mounted on the respective connector body, the latch being arranged to seat in the latch engaging portion of the other connector body when the connector members are in a mated condition, each latch including a latch release arm member extending rearwardly of the connector body coupling end, the latch release arm member of each latch being arranged to disengage the latch from the latch engaging portion of the other connector body when manually depressed whereby the connector members may be separated from a mated condition when the latch release arm members are simultaneously depressed.

18. A hermaphroditic connector as recited in claim 17 further including a jacket substantially covering each connector body and the spring biased latch and wherein the latch carried by each connector body is arranged to be disengaged from the latch engaging portion of the other connector body when the rearwardly extending latch release arm is depressed with the jackets in place over the connector bodies.

19. A hermaphroditic connector as recited in claim 18 wherein the latch engaging portion comprises a recess formed in the connector body.

20. A hermaphroditic electrical connector as recited in claim 19, wherein the electrical cable receiving end of each of the connector bodies is defined by a passage and further including an electrical cable fixedly mounted therein by a cable securing means.

21. A hermaphroditic electrical connector as recited in claim 20, wherein each of said electrical cables includes a pair of wires, whereby one of said wires of each cable is connected to the male plug and the other wire is secured to the female receptacle.

22. A hermaphroditic electrical connector as recited in claim 21, wherein said jacket covering said connector bodies is formed having a rearwardly extended nipple that is positioned in alignment with said respective passages, whereby said passages and said electrical cable wires are sealed within said respective connector members.

23. A hermaphroditic connector as recited in claim 19 wherein each of the body members defines an upper portion and a lower portion and wherein the spring biased latch is mounted on the upper portion and the latch engaging recess is formed on the lower portion of each connector body, the connector members being inverted with respect to each other in the mated condition.

24. A hermaphroditic connector as recited in claim 23 wherein each connector body is arranged to receive a tether and wherein the spring biased latch of each connector member is arranged to be disengaged from the latch engaging recess of the other connector member in response to a predetermined and opposing force being applied to the tethers, independently of the manual depression of the latch release arms whereby the connector members may be separated manually by the simultaneous depression of the latch release arms or by force applied to the tethers.

25. A hermaphroditic electrical connector as recited in claim 24, wherein each spring biased latch has a second arm extending rearwardly of the connector coupling end and joined to the latch release arm by a central base member and wherein the latch release arm is formed with an angularly disposed keeper member fixedly attached to a boss member formed in the respective jacket for locking engagement with the respective recess of the other connector body.

26. A hermaphroditic electrical connector as recited in claim 25, wherein said jackets are formed from flexible insulating material.

27. A hermaphroditic electrical connector as recited in claim 5, wherein said first and second connector bodies are formed from a plastic material.

28. A hermaphroditic connector of claim 25 wherein the spring biased latch of each connector member includes a keeper member which extends upwardly and forwardly from the latch release arm into the latch engaging recess of the opposing connector member, the keeper member generally forming an acute angle to the longitudinal axis, the degree of the acute angle determining the force required by the tethers to separate the connector members.

29. A hermaphroditic electrical connector as recited in claim 20, wherein each of said connector members includes a tether line.

30. A hermaphroditic electrical connector as recited in claim 20, wherein each of said jackets is formed from flexible insulating material.

31. A hermaphroditic electrical connector as recited in claim 20, wherein said flexible insulating material consists of rubber or plastic.

32. A hermaphroditic connector as recited in claim 24 wherein each connector body has a longitudinal axis, the front wall of each connector body being disposed generally in a plane perpendicular to the longitudinal axis with the cylindrical cavity and tubular post aligned parallel to the longitudinal axis, each connector body further defining a pair of spaced side wall sections extending on each side of the female receptacle sleeve to a height commensurate with the top of the tubular post.

33. A hermaphroditic connector as recited in claim 32 further including at least one sealing ring mounted on the outer surface of each tubular post for sealingly engaging an inner surface of the respective cylindrical cavity.

34. A hermaphroditic connector of claim 33 wherein the free forward end of the female receptacle post has a beveled surface for guiding the female receptacle into a male plug cavity.

35. A hermaphroditic electrical connector comprising:

a pair of substantially identical connector members, each connector member including a connector body having a coupling end and an electrical cable receiving end disposed opposite the coupling end, and a latch engaging portion adjacent the coupling end;

a male plug and a female receptacle mounted in each connector body, the plug and receptacle being arranged to engage the receptacle and plug, respectively, of the other connector body when the connector members are in a mated condition;

each connector member further including a spring biased latch mounted on the respective connector body adjacent the coupling end thereof, the latch being arranged to seat in the latch engaging portion of the other connector body when the connector members are in a mated condition, each latch including a latch release arm member extending rearwardly of the connector body coupling end, the latch release arm member of each latch being arranged to disengage the latch from the latch engaging portion of the other connector body when depressed whereby the connector members may be separated from a mated condition when the latch release arm members are simultaneously depressed, the latch being further arranged to disengage the latch engaging portion of the other connector member and cause the connector members to be separated from a mated condition in response to predetermined opposing forces being applied to the connector members.

* * * * *

UNITED STATES PATENT AND TRADEMARK OFFICE

CERTIFICATE OF CORRECTION

PATENT NO. : 5,800,196
DATED : September 1, 1998
INVENTOR(S) : Rudoy et al.

It is certified that error appears in the above-indentified patent and that said Letters Patent is hereby corrected as shown below:

Column 5, line 29, "housing" should read --housings--.

Column 7, line 16, "others" should read --other--.

Column 9, line 25, "5" should read --25--.

Signed and Sealed this

First Day of December, 1998

*Attest:*

*Attesting Officer*

BRUCE LEHMAN

*Commissioner of Patents and Trademarks*